US005157220A

United States Patent [19]

Schaffhauser et al.

[11] Patent Number: 5,157,220

[45] Date of Patent: Oct. 20, 1992

[54] STATIC ARMING BOMB PRIMING DEVICE

[76] Inventors: Brian Schaffhauser, 700 New Hyde Park Rd., New Hyde Park, N.Y. 11040; George Spector, 233 Broadway, New York, N.Y. 10007

[21] Appl. No.: 643,132

[22] Filed: Jan. 17, 1991

[51] Int. Cl.[5] ..... F42C 11/02; F42C 19/07

[52] U.S. Cl. ..... 102/210; 102/216

[58] Field of Search ..... 102/210; 216, 262, 263

[56] References Cited

U.S. PATENT DOCUMENTS 2,934,017 4/1960 Ellett ..... 102/210

3,337,758 8/1967 Brothers ..... 102/210

4,005,319 1/1977 Nilsson et al. ..... 102/210

*Primary Examiner*—Charles T. Jordan

[57] ABSTRACT

A static arming device for a bomb having a housing and a main charge therein is provided and consists of a portable power source and a fuse ignitor carried within the housing. The fuse ignitor is for detonating the main charge and is electrically connected to the power source. A mechanism is for selectively activating and deactivating the power source so as to arm and disarm the fuse. Another mechanism is for detonating the fuse ignitor after the power source is activated and when the rocket bomb impacts a target.

2 Claims, 1 Drawing Sheet

STATIC ARMING BOMB PRIMING DEVICE

BACKGROUND OF THE INVENTION

The instant invention relates generally to projectile primers and more specifically it relates to a static arming device which provides a portable controllable self contained power source that can be armed or disarmed at will.

There are available various conventional projectile primers which do not provide the novel improvements of the invention herein disclosed.

SUMMARY OF THE INVENTION

A primary object of the present invention is to provide a static arming device that will overcome the shortcomings of the prior art devices.

Another object is to provide a static arming device that includes a rocket bomb primer safety mechanism in which the rocket bomb has a portable controllable self contained power source that can be armed and disarmed at will.

An additional object is to provide a static arming device that includes a rocket bomb primer safety mechanism in which the bomb will be armed automatically when the rocket bomb is being propelled through the air.

A further object is to provide a static arming device that is simple and easy to use.

A still further object is to provide a static arming device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
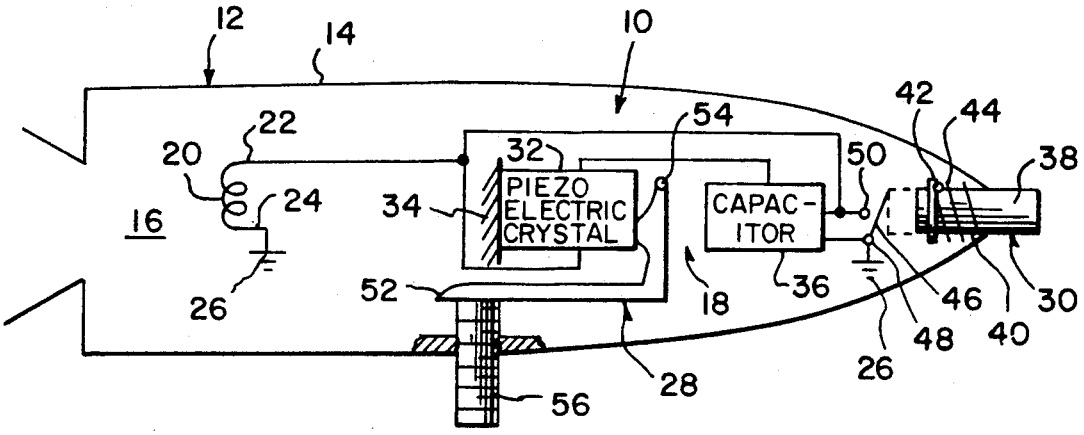
FIG. 1 is a diagrammatic cross section of a rocket bomb showing the electrical circuitry and the primer safety mechanism therein.

Turning now descriptively to the drawings, in which similar reference characters denote similar elements throughout the several views, FIG. 1 illustrates a static arming device 10 for a rocket bomb 12 having a housing 14 and a main charge 16 therein. The device 10 consists of a portable power source 18 carried within the housing 14. A fuse ignitor 20 is carried within the housing for detonating the main charge not illustrated but referred to in FIG. 1 as 16. The fuse ignitor 20 has a first end 22 connected to the power source 18 and a second end 24 connected to the ground 26. A mechanism 28 is for selectively activating and deactivating the power source 18 so as to arm and disarm the fuse ignitor 20.

Another mechanism 30 is for detonating the fuse ignitor 20 after the power source 18 is activated and when the rocket bomb 12 impacts a target.

The portable power source 18 includes a piezoelectric crystal 32 secured to the housing at 34 of the bomb 12 and is electrically connected to the first end 22 of the fuse ignitor 20. A capacitor 36 is electrically connected between the piezoelectric crystal 32 and the first end 22 of the fuse ignitor 20. When the piezoelectric crystal 32 is in a state of compression the capacitor 36 will remain charged.

The detonating mechanism 30 includes a detonator pin 38 carried in the front tip 40 of the housing 14. A washer 42 is affixed to the detonator pin 38 while a compression spring 44 is carried on the detonator pin 38 between the washer 42 and the front tip 40 which biases pin 38 outwardly of housing 14. A switch 46 is provided having one contact 48 connected to the ground 26 and another contact 50 connected to the first end 22 of the fuse ignitor 20. When the bomb 12 impacts the target, the detonator pin 38 will be forced into the housing 14 overcoming the compression spring 44 to close the switch 46 to detonate the fuse ignitor 20.

The selectively activating and deactivating mechanism 28 includes a canted cam lever 52 pivotally connected at 54 within the housing 14 which can compress and decompress the piezoelectric crystal 32. A safety screw 56 is threadable into the housing to bear against the canted cam lever 52. When the safety screw 56 is tightened it will make the canted cam lever 52 compress the piezoelectric crystal 32 to arm the fuse ignitor 20. When the safety screw 56 is loosened it will allow the canted cam lever 52 to decompress the piezoelectric crystal 32 to disarm the fuse ignitor 20.

Figure 2:
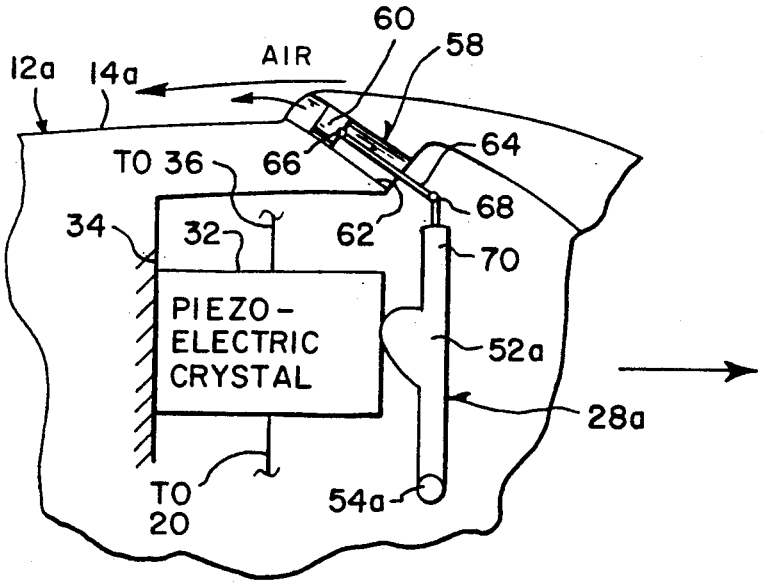
FIG. 2 is is a diagrammatic cross section of a portion of a modified rocket bomb showing the activation of the piezoelectric crystal when the rocket bomb is propelled through the air causing decreased air pressure on a piston which actuates a pivotable cam bearing against the crystal.

In FIG. 2, another type of selectively activating and deactivating mechanism **28*a* is shown and includes a cam lever 52*a* pivotally connected at its lower end 54*a* within the housing 14*a* which can compress and decompress the piezoelectric crystal 32. A piston assembly 58 is provided having a piston valve 60 slideable within an angular opening 62 in the housing 14*a*. A piston rod 64 is pivotally connected at one end 66 to the piston valve 60 and the other end 68 pivotly connected to the cam lever 52 at its upper end 70. When the rocket bomb 12*a* is propelled through the air, the piston valve 60 will be pulled up through the angular opening 62 in the housing 14*a* by decreased air pressure. This causes the cam lever 52*a* connected to the piston rod 64 to bear against the piezoelectric crystal 32 and compress it to arm the fuse ignitor 20**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A static arming device for a rocket bomb having a housing, said device comprising:

a) a portable power source carried within said housing;

b) a fuse ignitor carried within said housing for detonating the bomb, said fuse ignitor having a first end connected to said power source and a second end connected to ground;

c) means for activating said power source so as to arm said fuse ignitor;

d) means for detonating said fuse ignitor after said power source is activated and when the rocket bomb impacts a target;

e) a piezoelectric crystal secured to the housing of the rocket bomb and being electrically connected to the first end of said fuse ignitor;

f) a capacitor electrically connected between said piezoelectric crystal and the first end of said fuse ignitor so that when said piezoelectric crystal is in a state of compression said capacitor will remain charged;

g) a detonator pin carried in the front tip of the housing;

h) a washer affixed to said detonator pin;

i) a compression spring carried on said detonator pin between said washer and the front tip of the housing, biasing said pin outwardly of said housing;

j) a switch having one contact connected to ground and another contact connected to the first end of said fuse ignitor so that when the rocket bomb impacts the target, said detonator pin will go into the housing overcoming said compression spring and close said switch to detonate said fuse ignitor;

k) a canted cam lever pivotally connected within the housing which can compress and decompress said piezoelectric crystal; and l) a safety screw threadable into the housing to bear against said canted cam lever so that when said safety screw is tightened it will make said canted cam lever compress said piezoelectric crystal to arm said fuse ignitor and when said safety screw is loosened it will allow said piezoelectric crystal to decompress.

2. A static arming device as recited in claim 1, wherein said activating means includes:

a) a cam lever pivotally connected at its lower end within the housing which can compress and decompress said piezoelectric crystal; and b) a piston assembly having a piston valve slideable within an angular opening in the housing and a piston rod pivotally connected at one end to said piston valve and the other end pivotally connected to said cam lever at its upper end so that when the rocket bomb is propelled through the air said piston valve will be pulled up through the angular opening in the housing by decreased external air pressure causing said cam lever connected to said piston rod to bear against said piezoelectric crystal and compress it to arm said fuse ignitor.

* * * * *